US009409100B2

(12) United States Patent
Hillery

(10) Patent No.: US 9,409,100 B2
(45) Date of Patent: Aug. 9, 2016

(54) CONFETTI POPPER

(71) Applicant: Jonathan Paul Hillery, Hampton, NH (US)

(72) Inventor: Jonathan Paul Hillery, Hampton, NH (US)

( * ) Notice: Subject to any disclaimer, the term of this patent is extended or adjusted under 35 U.S.C. 154(b) by 19 days.

(21) Appl. No.: 14/303,976

(22) Filed: Jun. 13, 2014

(65) Prior Publication Data

US 2015/0360140 A1 Dec. 17, 2015

(51) Int. Cl.
*A63H 37/00* (2006.01)

(52) U.S. Cl.
CPC ..... *A63H 37/00* (2013.01)

(58) Field of Classification Search
CPC ..... A63H 27/10; A63H 37/00
See application file for complete search history.

(56) References Cited

U.S. PATENT DOCUMENTS 4,586,456 A * 5/1986 Forward ..... B63C 9/20 116/210
4,787,160 A * 11/1988 Balsamo ..... B65D 73/0092 206/469
4,920,674 A * 5/1990 Shaeffer ..... A63H 27/10 116/210
4,932,915 A * 6/1990 Boris ..... A63H 37/00 446/220
5,083,771 A * 1/1992 Tyner ..... A63H 27/10 116/DIG. 9
5,306,194 A * 4/1994 Epstein ..... A63H 27/10 446/220
5,338,242 A * 8/1994 Cheng ..... A63H 37/00 446/183
5,852,889 A * 12/1998 Rinaldi ..... B42D 15/045 40/124.06
6,158,588 A * 12/2000 Conti ..... B65D 5/4291 116/307
6,299,502 B1 10/2001 Cheng
6,447,364 B1 9/2002 Song
6,450,160 B1 9/2002 Fu et al.
6,478,651 B1 * 11/2002 Weir ..... G09F 19/00 40/212
7,350,477 B1 4/2008 Tilford et al.
8,469,768 B1 6/2013 Smith
8,858,350 B2 * 10/2014 Christoffel ..... A63H 27/005 446/220
2001/0053654 A1 12/2001 Watkins
2006/0199469 A1 * 9/2006 Du ..... A63H 37/00 446/475
2007/0249259 A1 10/2007 Pham
2010/0267309 A1 * 10/2010 Hyland ..... A63F 9/0079 446/188
2013/0263481 A1 * 10/2013 Nwosu ..... B42D 15/02 40/124.06
2014/0370776 A1 * 12/2014 Boren ..... A63H 27/06 446/56

* cited by examiner

*Primary Examiner* — Michael Dennis
*Assistant Examiner* — Urszula M Cegielnik
(74) *Attorney, Agent, or Firm* — Lambert & Associates; Gary E. Lambert; David J. Connaughton, Jr.

(57) ABSTRACT

A confetti popper device is provided. The confetti popper has a quantity of confetti stored within a body. A balloon or similar expandable membrane within the body may be inflated until a pressure within the interior against a cover reaches a certain pressure. Upon reaching this pressure, the cover of the body may release, causing the confetti to be ejected ("popped") from the body.

16 Claims, 2 Drawing Sheets

CONFETTI POPPER

BACKGROUND OF THE INVENTION

1. Field of the Invention

The present invention relates generally to confetti popper devices. More particularly, the present invention relates to a balloon based confetti popper that uses the inflation of a balloon to trigger the release ("popping") of confetti.

2. Description of Related Art

Airborne confetti and streamers are quite popular at various types of celebrations or similar events such as football games, parades, weddings, New Year's Eve parties, political conventions and like occasions. In the past, persons at such occasions have thrown handfuls of confetti or rolls of streamers which are limited by the volume that can be thrown and dispersed at a single time. Explosive devices, which have a cannon-type barrel and some type of explosive compound such as gun powder, have been used in the past to discharge large quantities of confetti and the like. However, explosive devices are inherently dangerous in that someone can be seriously injured by the explosion, if it goes astray. Furthermore, such devices are either normally very small and can handle relatively little confetti so as to provide some protection to the user against injury from the explosion or alternatively are larger and must be handled by someone who has expertise in the handling of such devices. Therefore, the use of explosive devices that can discharge large amounts of confetti are not available to the public and are quite limited in their use. Any device using gunpowder is highly regulated.

Moreover, this discharge of confetti is often coupled with an excitement and surprise element. One way to enhance the surprise is to make it so that it is not exactly known when the confetti will be released.

Therefore, what is needed is a device that may safely and effectively release confetti that may also provide an element of surprise to the user and surrounding people.

SUMMARY OF THE INVENTION

The subject matter of this application may involve, in some cases, interrelated products, alternative solutions to a particular problem, and/or a plurality of different uses of a single system or article.

In one aspect, a confetti popper device configured to eject or release confetti is provided. The device includes a body which defines an interior space. A quantity of confetti is positioned within this interior space, adjacent to an opening of the interior space. A cover seals this opening and is configured to release upon application of a pre-defined pressure within the interior space. A balloon or similar expandable membrane or body is positioned within the interior space. An inflation end of the balloon that is configured to allow inflating air into the balloon is oriented at a second opening of the body. The inflation end of the balloon is connected to an air pump. The air pump is configured to pump air into the balloon, thereby inflating the balloon. Upon sufficient inflation, the balloon, through the confetti, is configured to apply the pre-defined pressure within the interior space to release the cover, causing the confetti to be ejected from the interior space.

DETAILED DESCRIPTION

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention involves a confetti popper device configured to rapidly release ("pop") confetti based on the expansion and pressure of a balloon or similar membrane within the popper.

The confetti popper device may comprise a body defining an interior space, a quantity of confetti stored within the interior space until dispensed, a cover on one end of the body, and an inflatable balloon or membrane connected to an air pump to inflate the balloon or membrane. Upon sufficient interior pressure, the cover may release, rapidly releasing the confetti within the body.

The components of the present invention may be made of any materials. Generally, the body may be made of any material capable of storing the confetti and balloon during its inflation. Examples of materials which the body may be made include paper, plastic, metal, wood, composite materials, and the like. Further, the body may be of any shape and size capable of storing the confetti and balloon, and being sealed by the cover.

The confetti popper contemplated herein may be provided in any number of different variations. For example, the confetti popper may be provided to a consumer as a kit for assembly. The confetti popper may also be provided in a disposable embodiment, or, it may be reusable. Alternatively, some parts of the confetti popper may be reusable, such as the balloon, air pump, and/or body, while other parts of the confetti popper may be disposable such as the confetti, and cover.

In another embodiment, a plurality of different balloons of various shapes, sizes and thicknesses may be used, being swappable on and off of the air pump and/or into the body. In this embodiment, it will be even more unknown to a user when the confetti popper will release because the balloons will be less familiar.

Figure 1:
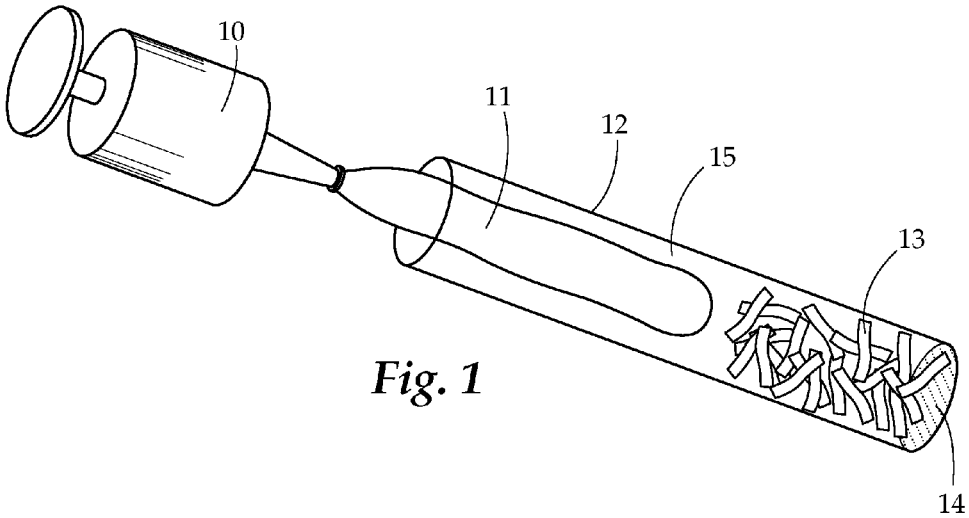
FIG. 1 provides a perspective view of an embodiment of the invention.

Turning now to FIG. 1, a perspective cut-away view of one embodiment of the present invention is provided. The confetti popper has a body 12 providing structure and support for the components of the confetti popper. The body 12 is generally tubular and cylindrical, however it should be understood that the body may be of any shape capable of storing confetti, and a balloon or similar membrane. For example, the body 12 may be rectangular, triangular, oblong, or the like. Further, its shape need not be uniform along its length or width. The body 12 defines an interior space 15. Within this interior space lies a balloon 11, as well as a quantity of confetti 13. The balloon 11 is shown herein as a long, thin balloon—often referred to as a rocket balloon. However, it should be understood that any balloon or similar membrane may be used. Similarly, the confetti 13 may be any sort of decorative material for ejection from the body 12. Examples of confetti 13 may include, but are not limited to: Confetti paper, confetti strings, lightweight paper strips, sparkles, shaped cut-outs (such as a star or lighting bolt), tissue paper, reflective items, streamers, and the like.

One end of the body 12 is sealed by a cover 14. This cover 14 may be releasable such as by breaking, rupturing, or an adhesive or connection otherwise giving way. The cover 14 is configured to release upon application of a sufficient, predetermined pressure from within the body 12. In some embodiments, the cover may be re-sealable. However, in many embodiments, the cover 14 is broken once released and not re-sealable.

An air pump 10 is attached to balloon 11 at its inflation end. The pump 10 may be permanently or removably attached to the balloon 11. The air pump 10 is configured to pump air into the balloon 11, causing it to increase in size. The air pump 10 may be a manual pump such as a hand or foot pump, or may be a mechanized pump such as an electric or other powered pump. The balloon 11 thus grows within the body 12 interior 15, increasing the pressure upon the confetti 13 as it does so. Once this pressure becomes high enough to release the cover 14, the confetti 13 is rapidly released from the body 12 cover end opening.

Figure 2:
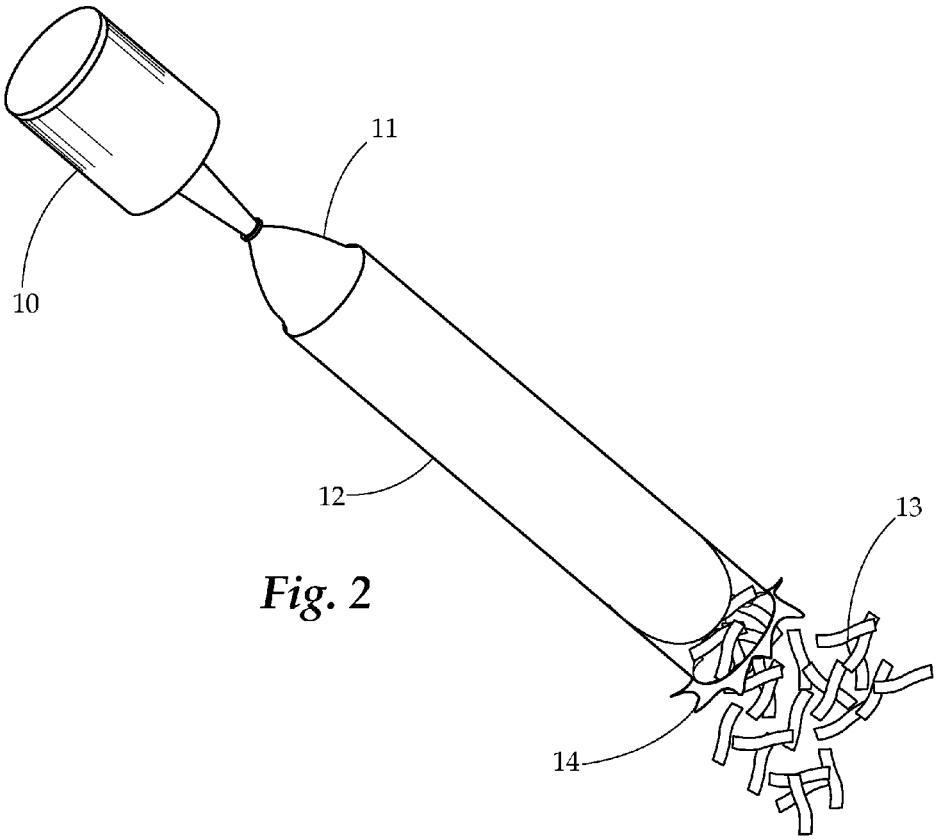
FIG. 2 provides a perspective view of another embodiment of the invention.

FIG. 2 shows another embodiment of the confetti popper in use releasing confetti. In this embodiment, the balloon 11 is enlarged, having been filled with air from the air pump 10. The balloon 11 has thus at least partially filled the body 12 interior 15, causing pressure to be applied on the confetti 13 within the interior 15. Upon a sufficient amount of pressure being applied to the confetti 13, and in turn the cover 14, the cover 14 will release, ejecting the confetti 13 as shown in this figure.

Figure 3:
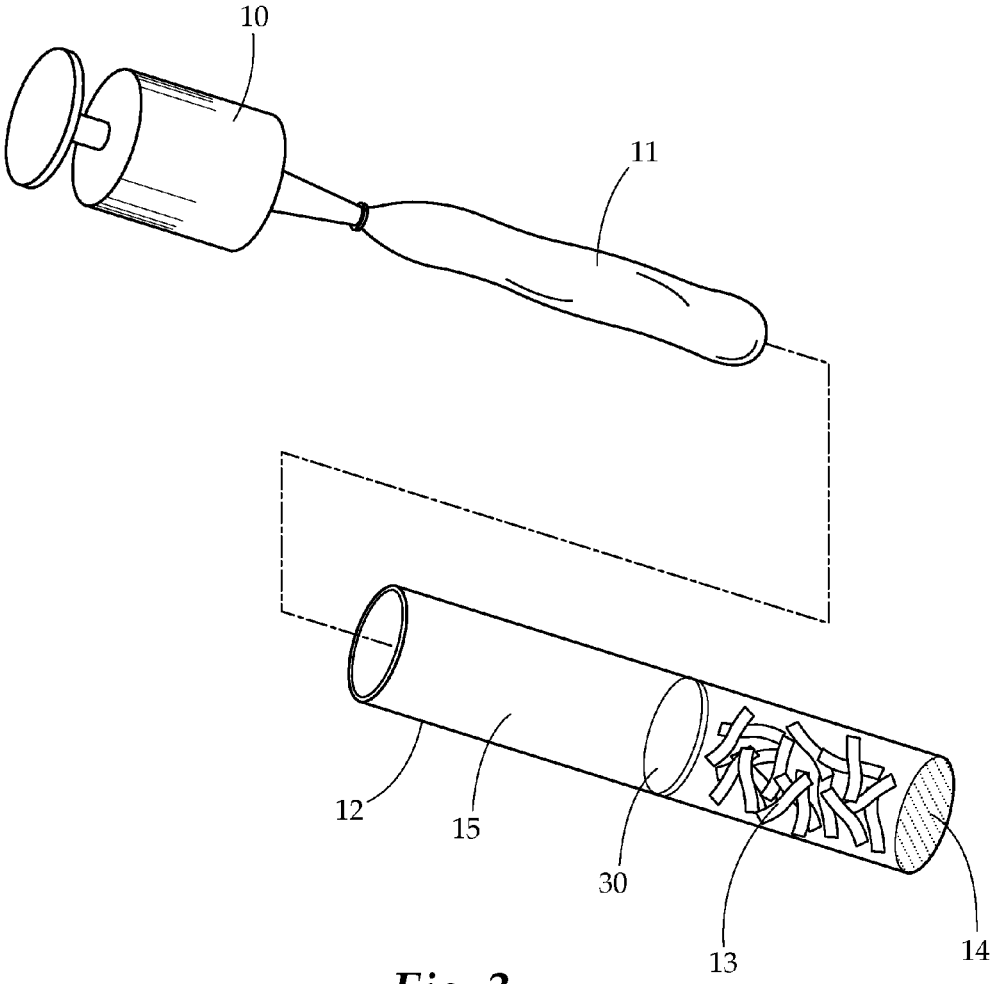
FIG. 3 provides a perspective view of still another embodiment of the invention.

FIG. 3 provides another embodiment of the confetti popper. In this embodiment, the balloon 11 and air pump 10 assembly are removed from an end of the body 12. The body 12 has an open end into which the balloon 11 may be inserted, allowing the balloon 11 to be removably positioned within the body interior 15. Confetti 13 is stored within the interior 15 of the body 12. The confetti 13 is held in place within the body 12 between the cover 14, and a flexible seal 30. In operation, the seal 30 is acted on by the inflating balloon 11. The seal exerts pressure on the confetti 13, which puts pressure on the cover 14. Upon release/rupture of the cover 14, the confetti 13 is ejected from the body 12 by the pressure on it from the seal 30. In most embodiments, the seal 30 may be flexible in order to allow it to apply pressure to the confetti 13 and force it out from the body 12 interior 15. In this embodiment shown, the balloon 11 is removable from the body 12. However, it should be understood that in other embodiments, the balloon 11 may be secured within the interior 15. This securing may be in any way capable of holding the balloon in place such as by adhesive, a seal, pressure connection, mechanical connection, and the like. The air pump 10 in this embodiment is removably attached to the balloon 11. In other embodiments, the balloon 11 may be permanently attached to the air pump 10.

The confetti popper may be used in any number of ways. In one embodiment, the air pump connected to the balloon may be activated, inflating the balloon. The air pump may pump air into the balloon until the confetti is released from the body. At this point, the air pumping may cease. For example, if the air pump is a hand pump embodiment, a user may pump or otherwise activate the pump until the confetti is released.

In another embodiment, the confetti popper may be loaded and then used. For example, the quantity of confetti may be loaded within the body. The first end of the body opening may be sealed with the cover, and the balloon may be inserted into the body on the opposite end from the first end. The balloon may then be connected to the air pump, and the air pump may be activated until the confetti is released.

In still another embodiment, the confetti popper may be provided with the confetti and cover pre-loaded and sealed. In this embodiment, a user may insert the balloon, either before or after being connected to the air pump. The user may then activate the pump until the confetti is released. The balloon may then be removed and used in another pre-loaded and sealed confetti popper.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A confetti popper device comprising:

a tubular body, the body defining an interior space;

a quantity of confetti disposed within the interior space;

a cover covering a first opening of the body, the first opening in communication with the interior space and the quantity of confetti, the cover configured to release from the first opening upon application of a pre-defined pressure on the cover within the interior space;

a balloon positioned within the interior space, an inflation end of the balloon having a mouth positioned at a second opening of the body;

the quantity of confetti positioned between the balloon and the cover;

an air pump, the air pump in communication with the balloon inflation end having a nozzle positioned through the mouth of the balloon, and configured to pump a quantity of air into the balloon, thereby inflating the balloon; and wherein the air pump is configured to inflate the balloon from a deflated state not having the quantity of air in it, to an inflated state having the quantity of air pumped into it by the air pump, while the balloon remains at least partially in the interior space of the body, the balloon, when in the inflated state being constructed and arranged to apply the pre-defined pressure within the interior space to release the cover, causing the confetti to be ejected from the interior space by the pre-defined pressure applied by the balloon while the balloon remains at least partially in the interior space of the body.

2. The confetti popper device of claim 1 wherein the confetti is positioned adjacent to the cover within the body interior space.

3. The confetti popper device of claim 1 wherein the body is cylindrical.

4. The confetti popper device of claim 1 wherein the balloon is a rocket balloon.

5. The confetti popper device of claim 1 wherein the balloon is removable from the body.

6. The confetti popper device of claim 1 wherein the balloon is attached to the body.

7. The confetti popper device of claim 1 wherein the cover is configured to rupture upon release.

8. The confetti popper device of claim 1 wherein an adhesive holding the cover to the body is configured to give way upon release of the cover.

9. The confetti popper device of claim 1 wherein the cover forms an air-tight seal over the body first opening.

10. The confetti popper device of claim 1 further comprising a seal within the interior of the body, the seal holding the confetti in place adjacent to the cover within the body interior.

11. The confetti popper device of claim 10 wherein the seal is flexible.

12. The confetti popper device of claim 1 wherein the air pump is a hand pump.

13. The confetti popper device of claim 1 wherein the air pump is an electrically powered pump.

14. The confetti popper device of claim 1 wherein the balloon is removable from the air pump.

15. The confetti popper device of claim 1 wherein the balloon is permanently attached to the air pump.

16. The confetti popper device of claim 1 wherein the body is a paper towel roll.

* * * * *